US008366407B2

(12) United States Patent
Hayashi et al.

(10) Patent No.: US 8,366,407 B2
(45) Date of Patent: Feb. 5, 2013

(54) DEVICE FOR REDUCING PULSATION IN A VARIABLE DISPLACEMENT COMPRESSOR

(75) Inventors: Shiro Hayashi, Kariya (JP); Hideki Mizutani, Kariya (JP); Sokichi Hibino, Kariya (JP); Suehiro Fukazawa, Kariya (JP); Taro Ozeki, Kariya (JP); Miyako Asagoe, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 1399 days.

(21) Appl. No.: 12/069,276

(22) Filed: Feb. 8, 2008

(65) Prior Publication Data

US 2008/0199329 A1 Aug. 21, 2008

(30) Foreign Application Priority Data

Feb. 16, 2007 (JP) ..... 2007-035566
Nov. 19, 2007 (JP) ..... 2007-299641

(51) Int. Cl.
*F04B 49/22* (2006.01)
*F04B 1/29* (2006.01)

(52) U.S. Cl. ..... 417/295; 417/222.2; 417/269

(58) Field of Classification Search ..... 417/222.2, 417/269, 270, 295, 298
See application file for complete search history.

(56) References Cited

U.S. PATENT DOCUMENTS

| | | | | |
|---|---|---|---|---|
| 6,257,848 | B1 | 7/2001 | Terauchi | |
| 2001/0026762 | A1 | 10/2001 | Fujita et al. | |
| 2005/0244279 | A1 * | 11/2005 | Murakami et al. | 417/222.2 |
| 2006/0165535 | A1 * | 7/2006 | Ota et al. | 417/222.2 |

FOREIGN PATENT DOCUMENTS

| | | |
|---|---|---|
| EP | 0 846 865 A1 | 6/1998 |
| JP | 11-324919 | 11/1999 |
| JP | 2000-136776 | 5/2000 |
| JP | 2000-161216 | 6/2000 |
| JP | 2005-337232 | 12/2005 |
| JP | 2006-125374 | 5/2006 |
| JP | 2006-207484 | 8/2006 |

OTHER PUBLICATIONS

European Search Report dated Sep. 29, 2008 issued by European Patent Office for application No. 08151384.8.-2315/1959139.

* cited by examiner

*Primary Examiner* — Devon Kramer
*Assistant Examiner* — Philip Stimpert
(74) *Attorney, Agent, or Firm* — Locke Lord LLP

(57) ABSTRACT

The present invention is directed to provide a device for reducing pulsation in a variable displacement compressor. The compressor is connected to an external refrigerant circuit. The device for reducing pulsation includes a flow passage and a control valve. The control valve includes a valve housing, a spool valve and a damper chamber. The spool valve has formed therethrough a flow hole. The damper chamber communicates with the flow passage adjacent to the external refrigerant circuit through the flow hole. Effective cross-sectional area and effective length of the flow hole are determined based on frequency of a specific pulsation of the refrigerant gas and volume of the damper chamber at the time of the development of the specific pulsation in such a manner that the specific pulsation is developed, resonance effect of a Helmholtz resonator takes place in the damper chamber.

6 Claims, 5 Drawing Sheets

DEVICE FOR REDUCING PULSATION IN A VARIABLE DISPLACEMENT COMPRESSOR

BACKGROUND OF THE INVENTION

The present invention relates to a device for reducing pulsation developed in a variable displacement compressor.

When the variable displacement compressor is operating with a low flow rate of refrigerant gas, pulsation of suction refrigerant gas is developed due to self-excited vibration of a suction valve of the compressor. Pulsation propagated out of the compressor may cause large vibration and noise. Various methods for reducing such pulsation are proposed. According to the methods, the effective area of the suction passage located upstream of the suction valve is controlled so as to reduce pressure fluctuation developed during operation of the compressor with a low flow rate of the refrigerant gas.

The Japanese Unexamined Patent Application Publication No. 2000-136776 or the first reference discloses a variable displacement compressor having a device for reducing pulsation of suction refrigerant gas. The compressor has a suction chamber and a suction port which communicate with each other through a gas passage. A valve chamber is provided between the gas passage and the suction port. An opening control valve is disposed vertically movably in the valve chamber for controlling the opening of the gas passage. The control valve is operable to change the opening of the gas passage in accordance with the flow rate of suction refrigerant gas. When the compressor is operating with a low flow rate of suction refrigerant gas, the pulsation of the suction refrigerant gas that is due to self-excited vibration of a suction valve of the compressor is reduced.

Specifically, a spring is disposed in the valve chamber for urging the control valve toward the suction port. The control valve is vertically movable by the pressure difference between the suction chamber and the suction port. The control valve is so arranged that the opening of the gas passage becomes maximum when the control valve is at the lowest position thereof and minimum when the control valve is at the highest position thereof. The valve chamber communicates with the suction chamber through a communication hole and also with the suction port through a hole formed in the control valve.

When the compressor is operating with a low flow rate of suction refrigerant gas, the control valve moves upward due to a small pressure difference between the suction chamber and the suction port and the opening of the gas passage is reduced, accordingly. In this case, part of the refrigerant gas at the suction port flows into the valve chamber through the hole of the control valve and then into the suction chamber through the communication hole. The pulsation of refrigerant gas developed during operation of the compressor with a low flow rate of refrigerant gas is rectified while the pulsation is propagated from the suction chamber to the suction port through the communication hole, the valve chamber and the hole of the control valve, so that noise is not developed. That is, the propagation of pressure fluctuation is reduced due to the sound deadening effect of the suction chamber having a large volume and the throttling effect of the hole of the control valve.

The Japanese Unexamined Patent Application Publication No. 2006-207484 or the second reference also discloses a variable displacement compressor having a device for reducing pulsation of suction refrigerant gas. The compressor has a suction chamber and a suction port which communicate with each other through a suction passage. A muffler is provided in the suction passage for reducing the pulsation of suction refrigerant gas. An opening control valve is provided upstream of the muffler for controlling the opening of the suction passage. The control valve has a valve chamber, a cylindrical valve body having a bottom at one end thereof, a cylindrical movable body having a bottom at one end thereof and a spring. The valve body and the movable body are movably disposed in the valve chamber. The spring is provided between the valve body and the movable body. A stop is provided in the inner wall of the valve chamber for restricting movement of the valve body. Another stop is also provided in the inner wall of the valve chamber for restricting movement of the movable body. A suction hole is formed between the valve chamber and the muffler. Suction pressure acts on the surface of the valve body adjacent to the suction port in the direction which causes the suction hole to be opened. Crank chamber pressure acts on the surface of the movable body adjacent to the bottom of the valve chamber through the communication passage in the direction which causes the suction hole to be closed.

When the compressor is operating with a low flow rate of suction refrigerant gas, the crank chamber pressure exceeds the suction pressure, so that the valve body and the movable body are moved while compressing the spring in the valve chamber in the direction which causes the suction hole to be closed. In the state where the movable body is in contact with the stop, the valve body is urged toward the suction port by the spring to reduce the opening of the suction hole to an extent that it is slightly opened, so that the sound deadening effect of the muffler is achieved thereby to reduce the pressure fluctuation. In addition, hermetically closing the space between the valve body and the movable body, damping effect is achieved thereby to prevent development of the noise that is due to the vibration of the valve body caused by the pulsation of suction refrigerant gas.

When the compressor of the first reference is operating with a low flow rate of suction refrigerant gas, the device for reducing pulsation of the compressor achieves the sound deadening effect developed between the suction chamber, the gas passage and the suction port by throttling the gas passage by the control valve. In addition, because the valve chamber communicates with the suction chamber and the suction port through the communication hole and the hole of the control valve, respectively, the device of the compressor achieves the sound deadening effect developed between the suction chamber, the communication hole, the valve chamber, the hole of the control valve and the suction port. However, the pulsation developed during operation of the compressor with a low flow rate of refrigerant gas cannot be reduced merely by the aforementioned sound deadening effects.

The device for reducing pulsation of the compressor of the second reference has the muffler in the suction passage. When the compressor is operating with a low flow rate of suction refrigerant gas, the suction hole of the muffler is throttled by the valve body of the control valve so as to achieve substantial sound deadening effect. However, providing the muffler in the compressor causes an increase of the size of the compressor, which makes it difficult to install a compressor in a limited space such as a vehicle engine room. The effect of pulsation reduction achieved by the provision of the muffler is not sufficient to compensate for the disadvantage of increased size of the compressor due to the provision of the muffler.

The present invention is directed to a device for reducing pulsation in a variable displacement compressor which is simplified and sufficiently achieves the effect for reducing the pulsation developed during operation of the compressor with a low flow rate of refrigerant gas without increasing the size of the compressor.

SUMMARY OF THE INVENTION

One aspect of the present invention provides a device for reducing pulsation in a variable displacement compressor. The compressor is connected to an external refrigerant circuit. The compressor includes a compressor housing, a piston and a reciprocating mechanism. The compressor housing has a crank chamber, a suction chamber, a discharge chamber and a plurality of cylinder bores. The piston is slidably disposed in each of the cylinder bores. The reciprocating mechanism is provided in the crank chamber for reciprocating the piston in the corresponding cylinder bore. As the piston is reciprocated, refrigerant gas in the suction chamber is drawn into the cylinder bore for compression and the compressed refrigerant gas is discharged into the discharge chamber. Pressure in the crank chamber is controlled to vary discharge amount of the refrigerant gas. The device for reducing pulsation includes a flow passage and a control valve. The flow passage is formed in the compressor housing and communicates with the external refrigerant circuit. The control valve is disposed in the flow passage for controlling opening of the flow passage. The control valve includes a valve housing, a spool valve and a damper chamber. The valve housing is disposed in the compressor housing. The spool valve is slidably disposed in the valve housing. The spool valve has formed therethrough a flow hole. The damper chamber is provided in the valve housing. The damper chamber communicates with the flow passage adjacent to the external refrigerant circuit through the flow hole. Effective cross-sectional area and effective length of the flow hole are determined based on frequency of a specific pulsation of the refrigerant gas and volume of the damper chamber at the time of the development of the specific pulsation in such a manner that when the specific pulsation is developed, resonance effect of a Helmholtz resonator takes place in the damper chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
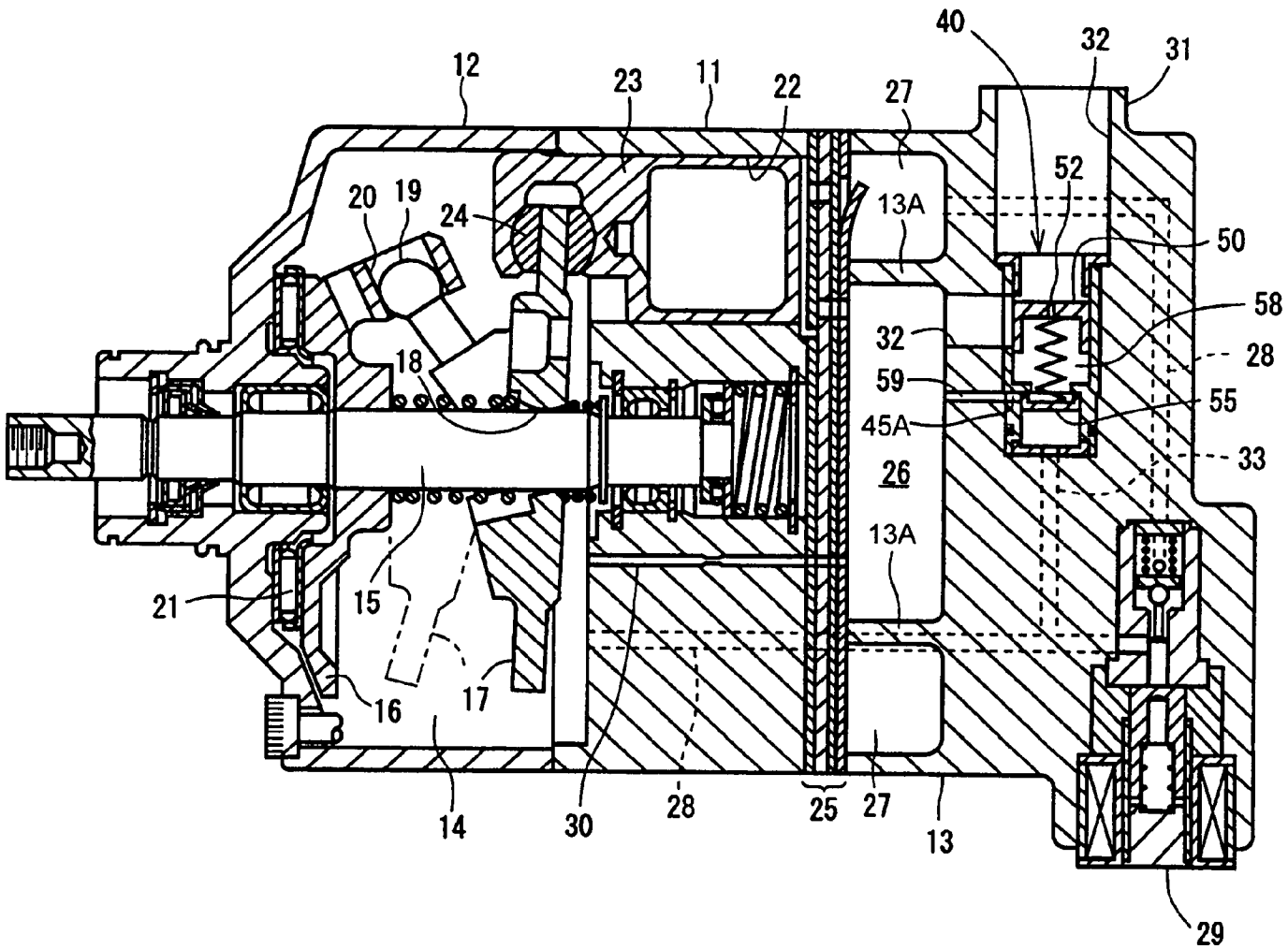
FIG. 1 is a longitudinal sectional view showing a variable displacement compressor according to a first embodiment of the present invention.
Figure 2:
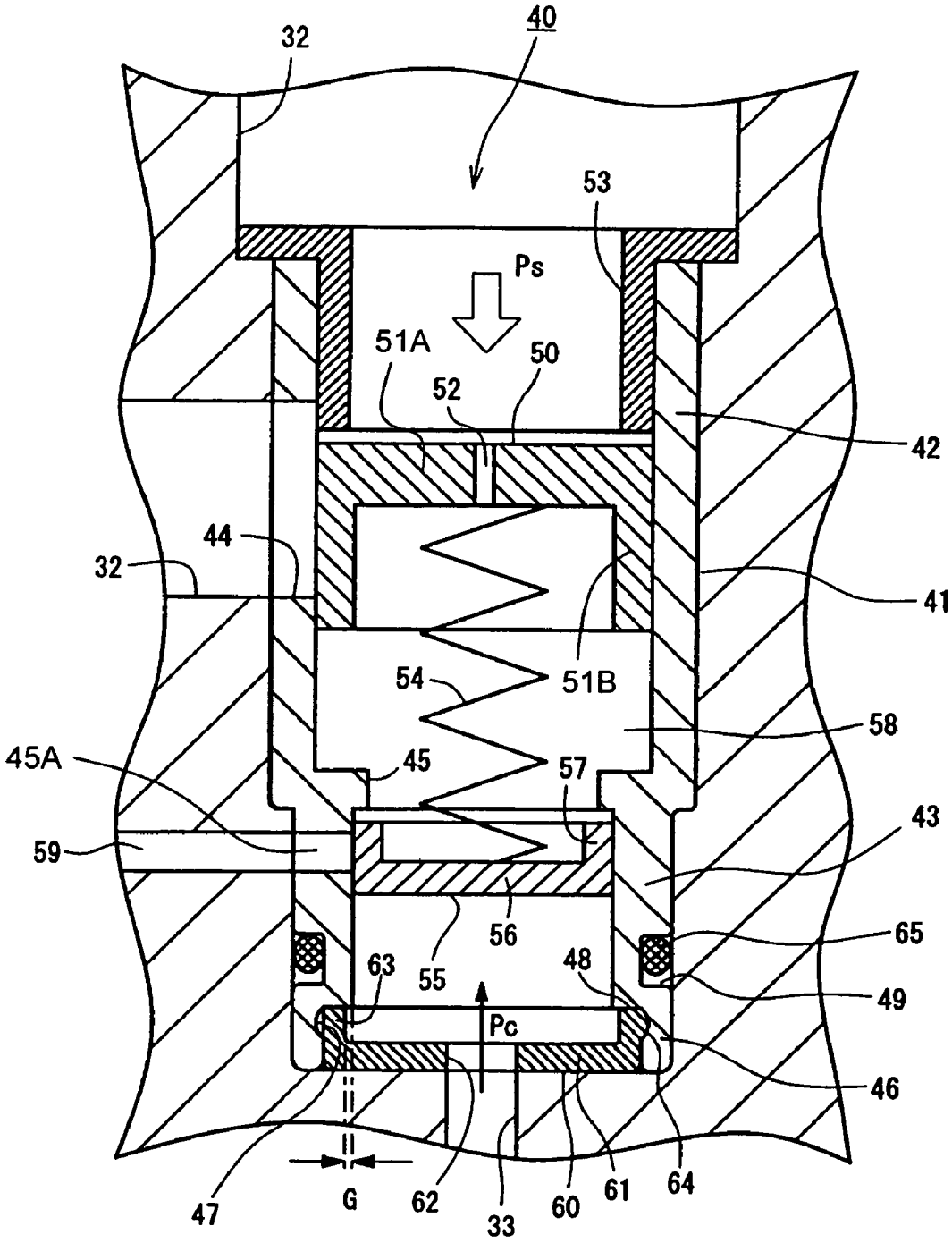
FIG. 2 is an enlarged longitudinal sectional view showing a control valve of the variable displacement compressor which is operating with a low flow rate of refrigerant gas.
Figure 3:
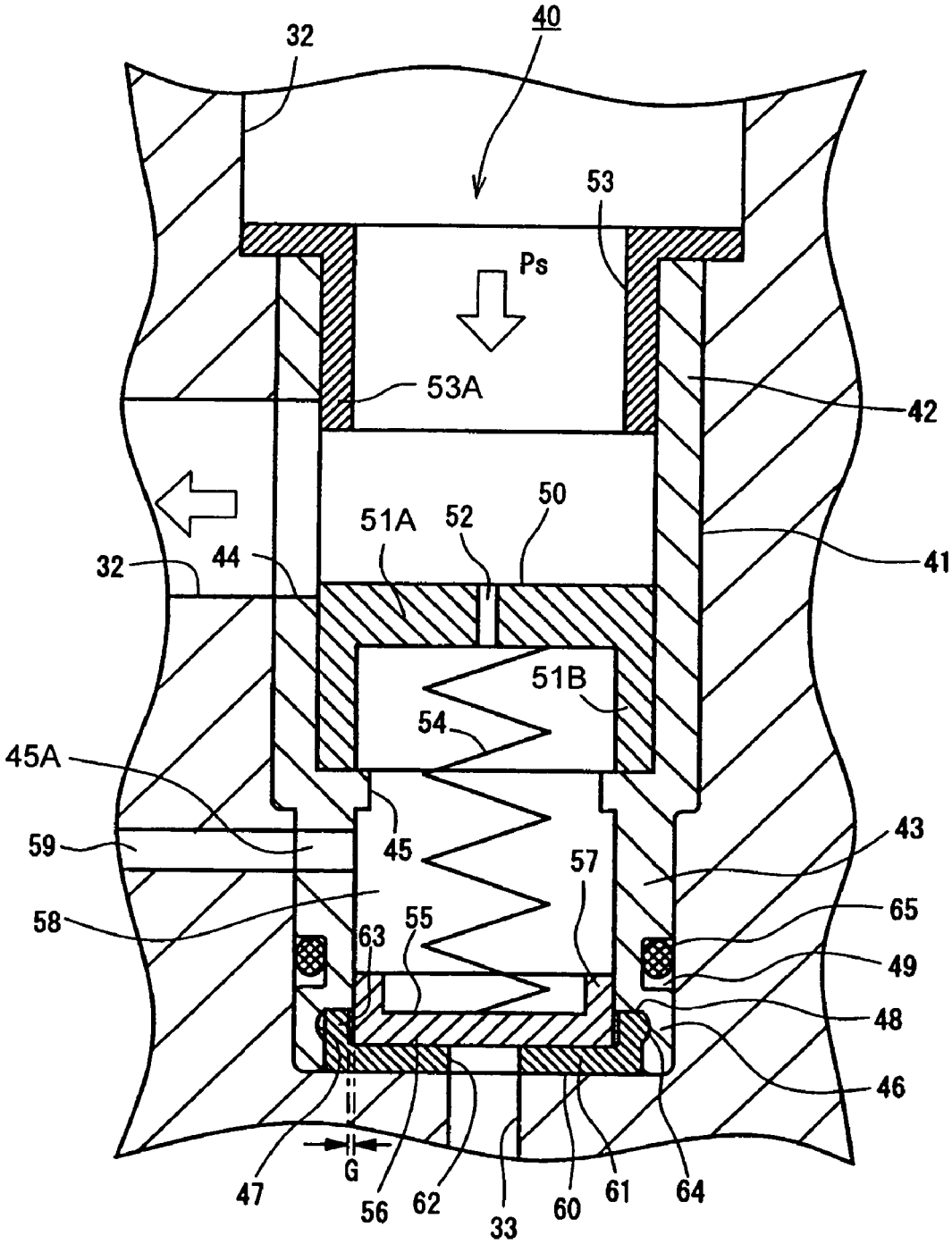
FIG. 3 is an enlarged longitudinal sectional view showing the control valve of the variable displacement compressor which is operating at its maximum displacement.

The following will describe a device for reducing pulsation in a variable displacement compressor according to a first embodiment of the present invention with reference to FIGS. 1 through 3. It is noted that the left-hand side and the right-hand side of the compressor as viewed in FIG. 1 correspond to the front and rear of the compressor, respectively. As shown in FIG. 1, the compressor include a cylinder block 11, a front housing 12 joined to the front end of the cylinder block 11 and a rear housing 13 joined to the rear end of the cylinder block 11. The front housing 12, the cylinder block 11 and the rear housing 13 cooperate to form a compressor housing. The cylinder block 11 and the front housing 12 define a crank chamber 14.

A rotary shaft 15 extends through the crank chamber 14 and rotatably supported by the cylinder block 11 and the front housing 12. The front end of the rotary shaft 15 extends out of the front housing 12 and connected to a mechanism (not shown) for receiving torque from a drive source (not shown) such as an engine or a motor of a vehicle.

In the crank chamber 14, a lug plate 16 is fixed to the rotary shaft 15 and a swash plate 17 is provided on the rotary shaft 15 so that the lug plate 16 engages with the swash plate 17. The swash plate 17 has formed at the center thereof a hole 18 through which the rotary shaft 15 extends. A pair of guide pins 19 project from the swash plate 17 and slidably inserted in a pair of guide holes 20 formed through the lug plate 16, respectively, so that the swash plate 17 is rotatable with the rotary shaft 15. The lug plate 16, the swash plate 17, the guide pins 19 and the guide holes 20 cooperate to form a reciprocating mechanism of the present invention. Due to the structure where the guide pins 19 are slidable in the guide holes 20, the swash plate 17 is also slidable in axial direction of the rotary shaft 15. In addition, the swash plate 17 is inclinably supported by the rotary shaft 15. A thrust bearing 21 is provided on the front inner-wall of the front housing 12 and rotatably supports the lug plate 16.

The cylinder block 11 has formed therethrough a plurality of cylinder bores 22 arranged around the rotary shaft 15 and a piston 23 is slidably received in each of the cylinder bores 22. Each piston 23 engages at the front end thereof with the outer periphery of the swash plate 17 through a pair of shoes 24. When the swash plate 17 rotates with the rotary shaft 15, each piston 23 reciprocates in its cylinder bore 22 through its pair of shoes 24.

A valve plate assembly 25 having suction valves and discharges valves is interposed between the cylinder block 11 and the rear housing 13. The valve plate assembly 25 and the rear housing 13 define a suction chamber 26 located radially inward in the rear housing 13 and a discharge chamber 27 located radially outward so as to surround the suction chamber 26. The suction chamber 26 and the discharge chamber 27 are separated by a partition 13A. The cylinder block 11 and the rear housing 13 have formed therethrough a supply passage 28 which provides fluid communication between the crank chamber 14 and the discharge chamber 27. The supply passage 28 passes through an electromagnetically-operated displacement control valve 29. The cylinder block 11 has formed therethrough a bleed passage 30 which provides fluid communication between the crank chamber 14 and the suction chamber 26.

The rear housing 13 has formed therein a suction port 31 which is connected to the external refrigerant circuit of the compressor. The suction port 31 and the suction chamber 26 communicate with each other through a suction passage 32 formed in the rear housing 13. The suction passage 32 serves as a flow passage of the present invention. A control valve 40 is disposed in the suction passage 32 for controlling the opening of the suction passage 32. As shown in FIGS. 2 and 3 in detail, the control valve 40 includes a cylindrical valve housing 41 made of resin and having an upper portion 42 and a lower portion 43. For the sake of explanatory convenience, the side of the control valve 40 where the upper portion 42 is located will be referred to as the upper side of the control valve 40 and the opposite side where the lower portion 43 is located as the lower side.

The cylindrical upper portion 42 of the valve housing 41 has inside and outside diameters that are greater than those of the cylindrical lower portion 43. The upper portion 42 is provided in the periphery thereof with an opening 44 through which the suction passage 32 is formed. It is noted that the inside diameters and outside diameters of the upper portion 42 and the lower portion 43 may be set as required according to the shape of the rear housing 13. A releasing hole 45A is formed through the lower portion 43 at an upper part thereof with a diameter smaller than that of the opening 44 for releasing the refrigerant gas from a damper chamber 58. The releasing hole 45A communicates with the suction chamber 26 through a communication passage 59.

A cylindrical spool valve 50 is disposed vertically slidably in the upper portion 42 of the valve housing 41. The cylindrical spool valve 50 has a bottom 51A facing the suction passage 32 adjacent to the suction port 31 and a side wall 51B that extends from the outer periphery of the bottom 51A downward. The bottom 51A has formed therethrough a flow hole 52 which is opened to the suction passage 32 adjacent to the suction port 31. Therefore, when the flow rate of refrigerant gas at the suction port 31 is minimum, the spool valve 50 is moved to its uppermost position where the opening 44 is closed completely by the side wall 51B. When the flow rate of refrigerant gas at the suction port 31 is maximum, on the other hand, the spool valve 50 is moved to its lowermost position where the opening 44 is completely opened.

A cylindrical cap 53 is provided in the upper portion 42 of the valve housing 41. The cylindrical cap 53 whose outside diameter corresponds to the inside diameter of the upper portion 42 is mounted, for example, by being pressed into the upper portion 42. The cap 53 has at the upper end thereof a flange which is engaged with the upper end of the upper portion 42 so as to position the cap 53 in place. The spool valve 50 moved to its uppermost position is brought into contact with the lower end 53A of the cap 53. Thus, the lower end 53A of the cap 53 serves as a stop. The valve housing 41 has formed between the upper potion 42 and the lower portion 43 thereof an annular projection 45 extending radially inwardly so that the spool valve 50 moved to its lowermost position is brought into contact with the projection 45. Thus, the annular projection 45 serves as a stop.

A back pressure valve 55 is disposed vertically slidably in the lower portion 43 of the valve housing 41 in a facing relation to the spool valve 50. The back pressure valve 55 has a bottom 56 and a side wall 57 extending upward from the outer periphery of the bottom 56. The damper chamber 58 is formed between the back pressure valve 55 and the spool valve 50 and a compression spring 54 is disposed in the damper chamber 58 for urging the spool valve 50 and the back pressure valve 55 away from each other. The lower portion 43 of the valve housing 41 has a bottom portion 46 whose inside diameter is increased thereby to form a stepped portion 48 and an annular groove 47 formed in the inner surface of the bottom portion 46.

As shown in FIG. 2, a cylindrical valve seat 60 is disposed in the bottom portion 46 of the valve housing 41. The valve seat 60 has a seat portion 61 and a circumferential wall 63 extending upward from the outer peripheral surface of the seat portion 61. The seat portion 61 has formed therethrough at the center thereof a hole 62. The vertical length of the circumferential wall 63 of the valve seat 60 is smaller than that of the side wall 57 of the back pressure valve 55. The circumferential wall 63 has formed on the outer circumference thereof a projection 64. If the circumferential wall 63 is formed of a resilient material, the projection 64 may be formed around the entirety of the circumferential wall 63. The valve seat 60 is so arranged in the bottom portion 46 that the upper end of the circumferential wall 63 is in contact with the stepped portion 48 and that the projection 64 is fitted in the groove 47. Therefore, the upward movement of the back pressure valve 55 is restricted by contact thereof with the annular projection 45 of the valve housing 41. With the back pressure valve 55 in contact with the lower surface of the annular projection 45, the releasing hole 45A is closed completely by the side wall 57 of the back pressure valve 55. The downward movement of the back pressure valve 55 is restricted by contact thereof with the upper surface of the seat portion 61 of the valve seat 60.

The circumferential wall 63 of the valve seat 60 has an inside diameter that is slightly larger than that of the lower portion 43 of the valve housing 41. Therefore, with the back pressure valve 55 positioned in contact with the seat portion 61 of the valve seat 60, there exists a clearance G between the outer circumferential surface of the side wall 57 of the back pressure valve 55 and the inner circumferential surface of the circumferential wall 63 of the valve seat 60, as shown in FIG. 2. By virtue of the presence of this clearance G, any foreign substance such as dust caught between the side wall 57 of the back pressure valve 55 and the inner circumferential surface of the lower portion 43 may be removed therefrom. In addition, due to the clearance G foreign substance is prevented from being caught between the back pressure valve 55 and the valve seat 60.

With the valve housing 41 of the aforementioned structure disposed in the rear housing 13, the opening 44 is connected with the suction passage 32 adjacent to the suction chamber 26 and the releasing hole 45A is connected with the communication passage 59. The hole 62 is connected with a passage 33 which is formed in the rear housing 13 and communicates with the crank chamber 14 through the supply passage 28.

An annular groove 49 is provided in the outer circumferential surface of the lower portion 43 of the valve housing 41 at a position slightly above the bottom portion 46. An O ring 65 is received in the annular groove 49 for preventing the refrigerant gas from leaking to the suction chamber 26 or the crank chamber 14 through the clearance between the rear housing 13 and the valve housing 41.

In the control valve 40 of the above structure, the spool valve 50 and the back pressure valve 55 are urged away from each other by the compression spring 54. The suction pressure Ps of refrigerant gas supplied from the external refrigerant circuit acts on the spool valve 50, while the crank chamber pressure Pc of refrigerant gas in the crank chamber 14 acts on the back pressure valve 55. Therefore, the control valve 40 is operable so as to be vertically movable in response to the pressure difference between the suction pressure Ps and the crank chamber pressure Pc. When the compressor is operating with a high flow rate of refrigerant gas, the back pressure valve 55 is lowered through the spool valve 50 and the compression spring 54 thereby to open the opening 44 and the releasing hole 45A of the control valve 40 as shown in FIG. 3. When the compressor is operating with a low flow rate of refrigerant gas, on the other hand, the spool valve 50 is elevated through the back pressure valve 55 and the compression spring 54 thereby to close part of the opening 44 as shown in FIG. 2, with the result that the flow of refrigerant gas in the suction passage 32 is highly throttled. In addition, while the compressor is operating with a low flow rate of refrigerant gas, the releasing hole 45A of the control valve 40 is gradually closed thereby to limit the movement of the refrigerant gas in the damper chamber 58. Thus, the throttling effect of the opening 44 is increased.

In the present embodiment, a specific pulsation which has the greatest influence on the compressor is selected from various pulsations developed during the compressor operation with a low flow rate of refrigerant gas. Then, the positional relation between the spool valve 50 and the back pressure valve 55 taking place when the specific pulsation is developed is experimentally measured. The volume of the damper chamber 58 is calculated from the results of the experimental measurement, and based on the frequency of the selected pulsation and the calculated volume, the effective cross-sectional area and the effective length of the flow hole 52 (or the distance between the suction passage 32 and the damper chamber 58) are determined so as to satisfy the following equation representing the principle of a Helmholtz resonator.

$$f=c/2\pi\sqrt{(S/LV)}$$

where f=resonance frequency, c=speed of sound (350 m/s under the temperature of 20 degrees Celsius), S=effective cross-sectional area of the flow hole 52, L=effective length of the flow hole 52, and V=volume of the damper chamber 58.

For example, when the frequency of the specific pulsation is determined at 400 hertz (Hz) and the positional relation between the spool valve 50 and the back pressure valve 55 taking place when the pulsation of suction refrigerant gas at the frequency of 400 Hz is developed is experimentally measured, the volume of the damper chamber 58 is 2800 $mm^3$. The effective cross-sectional area and the effective length of the flow hole 52 that satisfy the above equation based on the frequency of 400 Hz and the volume of 2800 $mm^3$ of the damper chamber 58 are 0.785 $mm^2$ (corresponding to $\phi 1$) and 1 mm, respectively. It is noted that based on the temperature of the refrigerant gas the speed of sound is determined at 150 m/s. By so setting, the resonance effect of the Helmholtz resonator is achieved in the damper chamber 58 when the pulsation having the frequency of 400 Hz is developed.

The spool valve 50, the compression spring 54 and the back pressure valve 55 are so arranged that the side wall 57 of the back pressure valve 55 closes the releasing hole 45A completely when the specific pulsation is developed. Therefore, when the specific pulsation is developed during compressor operation with a low flow rate of refrigerant gas, the resonance effect of the Helmholtz resonator takes place in the damper chamber 58 thereby to generate the resonance vibration, which attenuates the specific pulsation having the frequency.

The following will describe operation of the device for reducing pulsation of the compressor of the first embodiment. As the rotary shaft 15 is driven to rotate and the piston 23 is reciprocated, the refrigerant gas in the suction chamber 26 is drawn into the cylinder bore 22 through the suction valve of the valve plate assembly 25 for compression and the compressed refrigerant gas is discharged into the discharge chamber 27 through the discharge valve of the valve plate assembly 25. The high-pressure refrigerant gas in the discharge chamber 27 is delivered out of the compressor to the external refrigerant circuit (not shown).

The displacement control valve 29 is operable to adjust the crank chamber pressure Pc by controlling the relation between the amount of refrigerant gas flowing from the discharge chamber 27 into the crank chamber 14 through the supply passage 28 and the amount of refrigerant gas flowing from the crank chamber 14 into the suction chamber 26 through the bleed passage 30. As the crank chamber pressure Pc is changed, the pressure difference between the crank chamber 14 and the cylinder bore 22 through the piston 23 is changed thereby to alter angle of inclination of the swash plate 17. Therefore, the stroke length of the piston 23 is changed and the displacement of the compressor or discharge amount of the refrigerant gas is varied, accordingly.

As the displacement control valve 29 changes from its closed position to its fully open position, the inclination angle of the swash plate 17 is gradually decreased and the displacement of the compressor is reduced. Then, when the inclination angle of the swash plate 17 becomes minimum, the compressor operates at its minimum displacement. The control valve 40 operates in accordance with the operation of the displacement control valve 29.

When the compressor is operating with a low flow rate of refrigerant gas, the back pressure valve 55 is elevated. In this case, due to the urging force of the compression spring 54 and a small pressure difference between the suction pressure Ps and the pressure in the damper chamber 58, the spool valve 50 is pushed upward or in the direction which causes the opening 44 to be closed. Finally, the opening 44 is completely closed by the spool valve 50. When the opening 44 is partially closed, the flow rate of refrigerant gas in the suction passage 32 is throttled, so that propagation of the pulsation of suction refrigerant gas that is due to self-excited vibration of the suction valve in the suction chamber 26 is prevented.

When the specific pulsation is developed, the releasing hole 45A is closed by the back pressure valve 55 as shown in FIG. 2. Because the damper chamber 58 communicates with the suction passage 32 adjacent to the suction port 31 through the flow hole 52, the refrigerant gas in the damper chamber 58 is resonant with the pulsation of suction refrigerant gas propagating to the suction passage 32, so that the resonance effect of the Helmholtz resonator takes place. Consequently, the specific pulsation is attenuated and, therefore, the pulsation of suction refrigerant gas is prevented from propagating out of the compressor. When the specific pulsation is thus attenuated, the pulsations at frequencies around the frequency of the specific pulsation are reduced to some extent. Because of the synergetic effect of reduction of the pulsations at frequencies around the frequency of the specific pulsation and the aforementioned throttling effect, a greater effect of reducing the pulsation of suction refrigerant gas is obtained.

While the displacement control valve 29 is being closed from its fully open position, the inclination angle of the swash plate 17 is gradually increased thereby to increase the displacement of the compressor, and the compressor finally operates at its maximum displacement. During this process, the spool valve 50 is pushed down by the suction pressure Ps and the back pressure valve 55 is lowered through the compression spring 54, accordingly. Because the releasing hole 45A is then fully opened, the refrigerant gas in the damper chamber 58 flows easily toward the suction chamber 26. The spool valve 50 is lowered rapidly thereby to fully open the opening 44 at an early stage, so that good operating efficiency of the compressor at its maximum displacement is ensured. Thus, an opening between the releasing hole 45A and the damper chamber 58 is variable so as to be fully closed and fully opened by the movement of the back pressure valve 55.

The back pressure valve 55 lowered to its lowermost position is brought into contact with the seat portion 61 of the valve seat 60 as shown in FIG. 3. Any foreign substance such as dust caught between the inner circumferential surface of the lower portion 43 and the outer circumferential surface of the back pressure valve 55 is removed therefrom by virtue of the presence of the clearance G.

The following will describe advantageous effects of the first embodiment.

(1) The device for reducing pulsation according to the first embodiment uses the damper chamber 58 of the control valve 40. The specific pulsation is selected from various pulsations of suction refrigerant gas developed during compressor operation with a low flow rate of suction refrigerant gas. Based on the frequency of the specific pulsation and the volume of the damper chamber 58 at the time of the development of the specific pulsation, the effective cross-sectional area and the effective length of the flow hole 52 are determined. Thus, the control valve 40 can be made simple, but provides an effect of drastically reducing the pulsation of suction refrigerant gas of the variable displacement compressor.

(2) While the compressor is operating with a low flow rate of refrigerant gas, the damper chamber 58 communicates with the suction passage 32 only through the flow hole 52 when the specific pulsation is developed, so that the resonance effect of the Helmholtz resonator takes place in the damper chamber 58 and the specific pulsation is attenuated.

(3) When the specific pulsation is attenuated, the pulsations at frequencies around the frequency of the specific pulsation are also attenuated to some extent, which helps to reduce the pulsation which produces abnormal vibration and noise outside of the compressor.

(4) Due to the synergetic effect of throttling the refrigerant gas flow through the opening 44 and the resonance of the Helmholtz resonator in the damper chamber 58, an increased effect of reducing the pulsation of suction refrigerant gas is obtained.

The present invention is not limited to the first embodiment, but may be modified in various ways within the scope of the invention.

In the first embodiment, the back pressure valve 55 fully closes the releasing hole 45A when the compressor is operating with a low flow rate of refrigerant gas, thereby achieving the resonance effect of the Helmholtz resonator in the damper chamber 58. However, partially or entirely opening the releasing hole 45A, the resonance effect of the Helmholtz resonator is achieved. That is, because the suction chamber 26 is substantially closed with the releasing hole 45A opened, the effective cross-sectional area and the effective length of the flow hole 52 may be determined based on the total volume of the suction chamber 26, the communication passage 59, the releasing hole 45A and the damper chamber 58.

Figure 4:
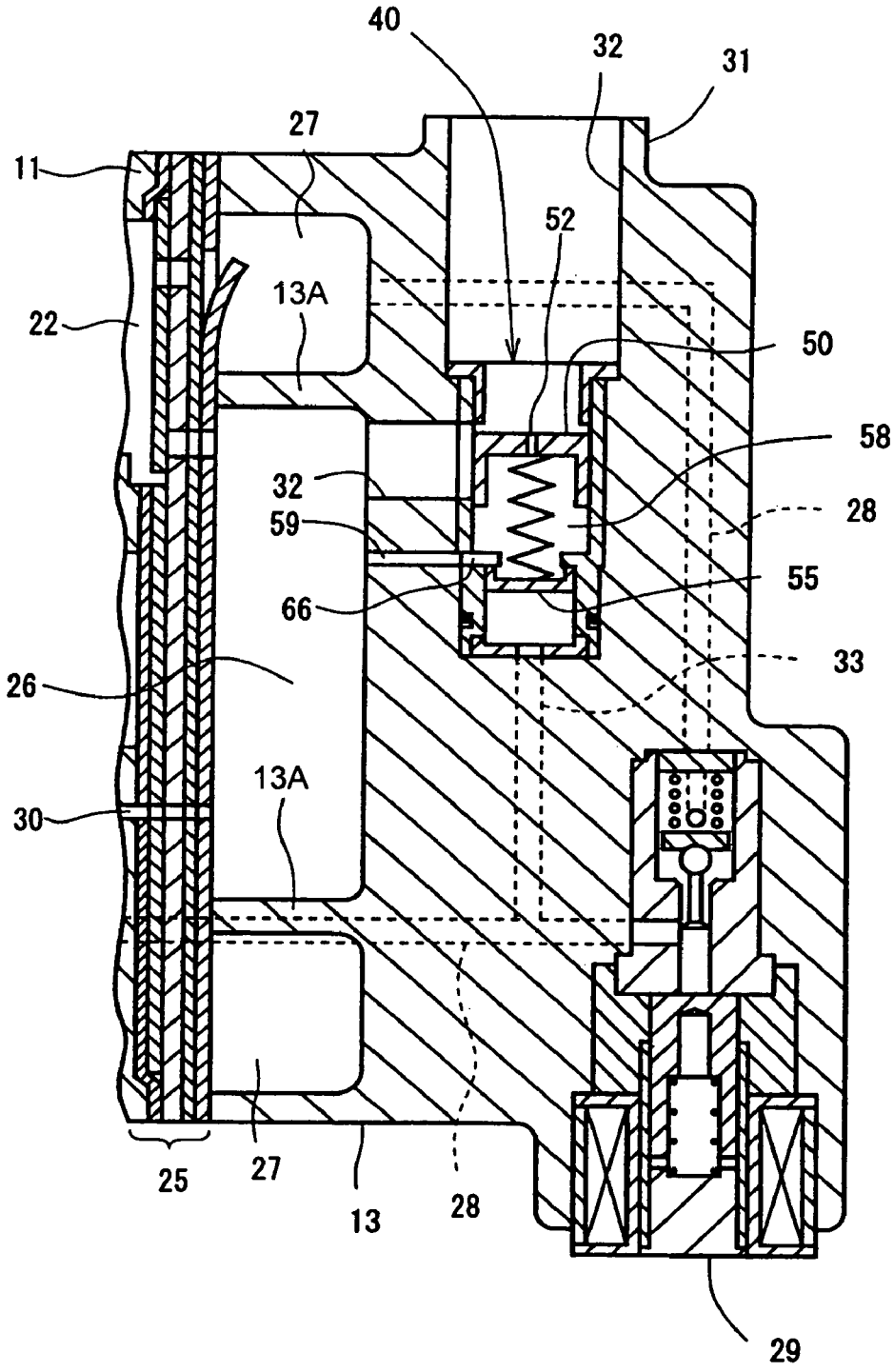
FIG. 4 is a sectional view showing rear housing of a variable displacement compressor according to a modification of the first embodiment.
Figure 5:
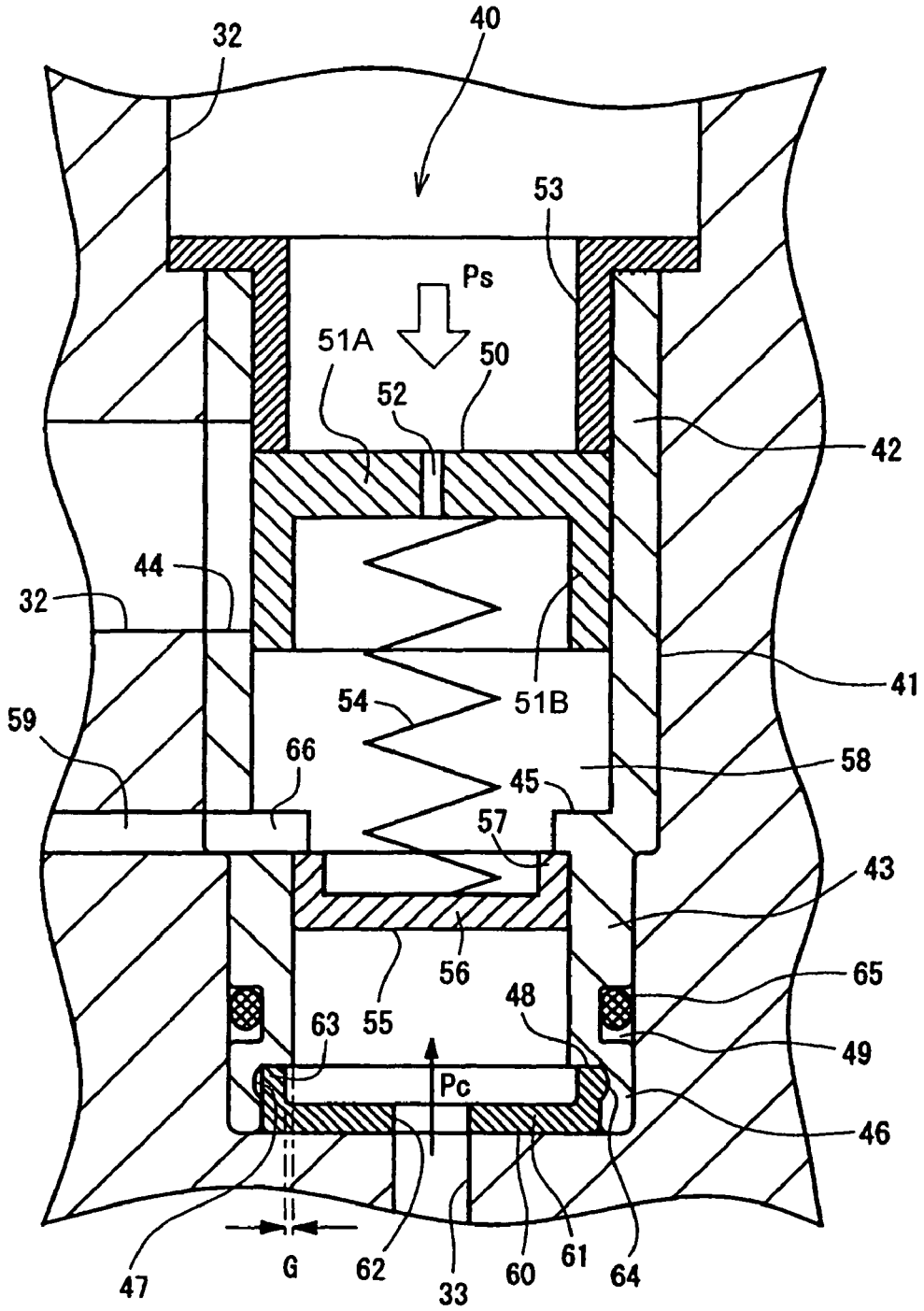
FIG. 5 is an enlarged longitudinal sectional view showing a control valve of the variable displacement compressor of FIG. 4 which is operating with a low flow rate of refrigerant gas.

Referring to FIGS. 4 and 5 showing a modification of the first embodiment, it differs from the first embodiment in that the position of the releasing hole 45A is changed. Therefore, the same reference numerals are used for the same parts or elements as those of the first embodiment and the description thereof is omitted. As shown in FIG. 5, a releasing hole 66 of the modification is provided at the position of the annular projection 45 of the connecting between the upper portion 42 and the lower portion 43 of the valve housing 41, and communicates with the suction chamber 26 through the communication passage 59. When the spool valve 50 is lowered due to the suction pressure Ps during compressor operation with a low flow rate of suction refrigerant gas, the releasing hole 66 serves to release the refrigerant gas in the damper chamber 58 to the suction chamber 26 thereby to rapidly move the spool valve 50 downward as in the case of the first embodiment. However, the releasing hole 66 of the present modification is constantly opened to the damper chamber 58 regardless of the position of the spool valve 50 and the back pressure valve 55. For producing the resonance effect of the Helmholtz resonator in the damper chamber 58 of the present modification, the positional relation between the spool valve 50 and the back pressure valve 55 taking place when a specific pulsation is developed during compressor operation with a low flow rate of the suction refrigerant gas is experimentally measured, on the basis of which the volume of the damper chamber 58 is calculated. In the present modification, the total volume of the releasing hole 66, the communication passage 59, the suction chamber 26 and the damper chamber 58 is regarded as the volume of a damper chamber. Thus, based on the frequency of the specific pulsation and the volume of the damper chamber, the effective cross-sectional area S and the effective length L of the flow hole 52 satisfying the aforementioned equation are calculated and the spool valve 50 is made with the appropriate cross-sectional area S and length L of the flow hole 52 for achieving the resonance effect of the Helmholtz resonator. As in the case of the first embodiment, the device for reducing pulsation of the present modification reduces the pulsation developed during compressor operation with a low flow rate of refrigerant gas.

The device for reducing pulsation in a variable displacement compressor of the present invention may also be provided between the discharge chamber 27 and the external refrigerant circuit.

Although in the first embodiment the frequency of 400 Hz for the specific pulsation is used as an example, the frequency other than 400 Hz may also be employed. However, in the experiment using a device for reducing pulsation which does not meet the above equation, the pulsation of suction refrigerant gas is increased in the range of the frequencies of 200 Hz to 600 Hz. Therefore, it is preferable to determine the frequency in the above range. In the first embodiment, any values for the volume of the damper chamber 58, the effective cross-sectional area and the effective length of the flow hole 52 and the speed of sound based on the temperature of suction refrigerant gas may be selected as long as the equation is met.

In the first embodiment, the control valve 40 may dispense with the back pressure valve 55 and the compression spring 54.

Therefore, the present examples and embodiments are to be considered as illustrative and not restrictive, and the invention is not to be limited to the details given herein but may be modified within the scope of the appended claims.

What is claimed is:

1. A device for reducing pulsation in a variable displacement compressor, wherein the compressor is connected to an external refrigerant circuit, the compressor comprising:

a compressor housing having a crank chamber, a suction chamber, a discharge chamber and a plurality of cylinder bores;

a plurality of pistons slidably received in the respective cylinder bores; and a reciprocating mechanism provided in the crank chamber for reciprocating the pistons in the cylinder bores, wherein as the pistons are reciprocated, refrigerant gas in the suction chamber is drawn into the cylinder bores for compression and the compressed refrigerant gas is discharged into the discharge chamber, wherein pressure in the crank chamber is controlled to vary a discharge amount of the refrigerant gas;

the device for reducing pulsation comprising:

a suction passage formed in the compressor housing, wherein the suction chamber communicates with the external refrigerant circuit through the suction passage;

a control valve disposed in the suction passage for controlling opening of the suction passage, the control valve comprising:

a valve housing disposed in the compressor housing;

a spool valve slidably disposed in the valve housing, wherein the spool valve has formed therethrough a flow hole, wherein pressure in the suction passage acts on the spool valve to move the spool valve;

a damper chamber provided in the valve housing, wherein the damper chamber communicates with the suction passage adjacent to the external refrigerant circuit through the flow hole, a back pressure valve slidably disposed in the valve housing, wherein the back pressure valve is located in a facing relation to the spool valve so that the damper chamber is formed between the back pressure valve and the spool valve, wherein the pressure in the crank chamber acts on the back pressure valve to move the back pressure valve;

a compression spring disposed in the damper chamber for urging the spool valve and the back pressure valve away from each other; and a releasing hole formed through the valve housing for releasing the refrigerant gas from the damper chamber, wherein a communication passage is formed in the compressor housing, wherein the releasing hole communicates with the suction chamber through the communication passage, wherein an opening between the releasing hole and the damper chamber is variable so as to be fully closed and fully opened by the movement of the back pressure valve, wherein effective cross-sectional area and effective length of the flow hole are determined based on frequency of a specific pulsation of the refrigerant gas and volume of the damper chamber at the time of the development of the specific pulsation in such a manner that when the specific pulsation is developed, resonance effect of a Helmholtz resonator takes place in the damper chamber, wherein the effective cross-sectional area and the effective length of the flow hole are determined based on frequency of the specific pulsation of the refrigerant gas and the total volume of the damper chamber at the time of the development of the specific pulsation, the suction chamber, the releasing hole and the communication passage.

2. The device for reducing pulsation according to claim 1, wherein the following equation is satisfied:

$$f=c/2\pi\sqrt{(S/LV)}$$

where f=the frequency of the specific pulsation,

V=the volume of the damper chamber at the time of the development of the specific pulsation, S=the effective cross-sectional area of the flow hole, L=the effective length of the flow hole, and c=speed of sound determined based on temperature of the refrigerant gas.

3. The device for reducing pulsation according to claim 1, wherein the valve housing has a cylindrical upper portion and a cylindrical lower portion, wherein the upper portion of the valve housing has inside and outside diameters that are greater than those of the lower portion.

4. The device for reducing pulsation according to claim 3, wherein the upper portion is provided with an opening through which the suction passage is formed, wherein diameter of the opening of the upper portion is larger than that of the releasing hole.

5. The device for reducing pulsation according to claim 3, wherein a cylindrical cap is provided in the upper portion adjacent to the external refrigerant circuit, wherein the cap adjacent to the spool valve serves as a stop.

6. The device for reducing pulsation according to claim 3, wherein the valve housing has formed between the upper potion and the lower portion thereof an annular projection extending radially inwardly, wherein the annular projection serves as a stop.

* * * * *